US007623093B2

(12) United States Patent
Shinohe et al.

(10) Patent No.: US 7,623,093 B2
(45) Date of Patent: Nov. 24, 2009

(54) ARRAY DISPLAY APPARATUS

(75) Inventors: Koji Shinohe, Kawasaki (JP); Kenji Awamoto, Kawasaki (JP)

(73) Assignee: Shinoda Plasma Co., Ltd., Hyogo (JP)

( * ) Notice: Subject to any disclaimer, the term of this patent is extended or adjusted under 35 U.S.C. 154(b) by 684 days.

(21) Appl. No.: 11/212,778

(22) Filed: Aug. 29, 2005

(65) Prior Publication Data

US 2006/0267862 A1 Nov. 30, 2006

(30) Foreign Application Priority Data

May 26, 2005 (JP) ..... 2005-154275

(51) Int. Cl.
*G09G 3/28* (2006.01)

(52) U.S. Cl. ..... 345/63

(58) Field of Classification Search ..... 345/47, 345/60, 63, 65, 66, 67, 71; 313/484–493, 313/505, 582–587, 594
See application file for complete search history.

(56) References Cited

U.S. PATENT DOCUMENTS

| | | | | |
|---|---|---|---|---|
| 6,356,012 | B1 * | 3/2002 | Bae | 313/479 |
| 6,577,060 | B2 * | 6/2003 | Tokai et al. | 313/581 |
| 6,771,307 | B2 * | 8/2004 | Waki et al. | 348/189 |
| 6,794,812 | B2 * | 9/2004 | Yamada et al. | 313/493 |
| 6,836,064 | B2 * | 12/2004 | Yamada et al. | 313/485 |
| 6,890,087 | B2 * | 5/2005 | Ono | 362/260 |
| 7,122,961 | B1 * | 10/2006 | Wedding | 313/582 |
| 7,157,854 | B1 * | 1/2007 | Wedding | 313/582 |
| 7,176,628 | B1 * | 2/2007 | Wedding | 313/582 |
| 7,405,520 | B2 * | 7/2008 | Ueno et al. | 313/634 |
| 2003/0214225 | A1 | 11/2003 | Yamada et al. | |
| 2005/0037843 | A1 * | 2/2005 | Wells et al. | 463/30 |
| 2006/0267862 | A1 * | 11/2006 | Shinohe et al. | 345/47 |

FOREIGN PATENT DOCUMENTS

| | | |
|---|---|---|
| CN | 1461033 | 12/2003 |
| JP | 61-103187 | 5/1986 |
| JP | 2001-176315 | 6/2001 |
| JP | 2003-086141 | 3/2003 |
| JP | 2003-092085 | 3/2003 |

OTHER PUBLICATIONS

Office Action issued in corresponding Chinese Patent Application No. 200510103408.2, on Feb. 29, 2008.

* cited by examiner

*Primary Examiner*—Richard Hjerpe
*Assistant Examiner*—Tom V Sheng
(74) *Attorney, Agent, or Firm*—Staas & Halsey LLP

(57) ABSTRACT

The present invention provides an array display apparatus in which multiple light-emitting tubes each having a fluorescent substance layer inside are aligned and a discharge is generated within these multiple light-emitting tubes, whereby the fluorescent substance layers within the light-emitting tubes are caused to emit light thereby to display an image. The array display apparatus displays an image of uniform luminance irrespective of the planar shape of a display surface when image data representing a uniform image is inputted.

5 Claims, 17 Drawing Sheets

ARRAY DISPLAY APPARATUS

BACKGROUND OF THE INVENTION

1. Field of the Invention

The present invention relates to an array display apparatus in which multiple light-emitting tubes each having a fluorescent substance layer inside are aligned and a discharge is generated within these multiple light-emitting tubes, whereby the fluorescent substance layers within the light-emitting tubes are caused to emit light thereby to display an image.

2. Description of the Related Art

As a large-sized image display device which performs spontaneous light emission there has been proposed a technique in which a large number of light-emitting lines formed from glass tube, each of which has a fluorescent substance layer and the like inside, are arrayed, whereby the light emission for each part of each of the light-emitting lines is controlled thereby to display an image (refer to the Japanese Patent Laid-Open No. 61-103187).

In each of the light-emitting lines, a protective film, such as an MgO film, and a fluorescent substance layer are formed in the interior of a glass tube and a discharge gas consisting of Ne and Xe, for example, is filled in the glass tube. The fluorescent substance layer is formed on a supporting member called a boat, which is a mounted part having a sectional shape close to a semicircle, and this supporting member (boat) is inserted into the glass tube. After that, the glass tube is evacuated within a vacuum chamber while being heated and both ends of the glass tube are sealed after a discharge gas is filled. A large number of light-emitting lines thus fabricated are arrayed in parallel and fixed and electrodes are provided for these light-emitting lines. By applying a voltage to these electrodes, a discharge is generated in the interior of the light-emitting lines, whereby the fluorescent substance layer is caused to emit light.

FIG. 1 is a perspective view which shows the basic structure of a plasma tube array, which is an example of an array display apparatus.

In the plasma tube array (PTA) 100 shown here, light-emitting lines 10R, 10G, 10B, 10R, 10G, 10B, . . . , in which fluorescent substance layers generating respectively fluorescent light of the colors red (R), green (G) and blue (B) are disposed and a discharge gas is sealed, are arrayed parallel to each other and in a planar manner as a whole, and a transparent front surface supporting board 20 and a back surface supporting board 30 are disposed respectively on a display surface, which is a front surface, and a back surface of these many arrayed light-emitting lines 10R, 10G, 10B, 10R, 10G, 10B, . . . , with these many arrayed light-emitting lines 10R, 10G, 10B, 10R, 10G, 10B, . . . sandwiched between the front surface supporting board 20 and the back surface supporting board 30.

On the front surface supporting board 20 is formed a display electrode pair 21, which is constituted by two display electrodes 211, 212 extending parallel to each other in the array direction of the many light-emitting lines 10R, 10G, 10B, 10R, 10G, 10B, . . . , i.e., in a direction in which the display electrode pair 21 spans these many light-emitting lines 10R, 10G, 10B, 10R, 10G, 10B, . . . . This display electrode pair 21 is arrayed in multiple numbers in the longitudinal direction of the light-emitting lines 10R, 10G, 10B, 10R, 10G, 10B, . . . . The two display electrodes 211, 212 which constitute one display electrode pair 21 are constituted by bus electrodes 211*a*, 212*a* made of metal (for example, Cr/Cu/Cr), each formed on a side away from each other, and transparent electrodes 211*b*, 212*b* made from ITO thin films, each formed on a side close to each other. The bus electrodes 211*a*, 212*a* serve to lower the electric resistance of the display electrodes 211, 212, and the transparent electrodes 211*b*, 212*b* serve to ensure bright display by causing the luminous light in the light-emitting lines 10R, 10G, 10B, 10R, 10G, 10B, . . . to be transmitted to the front surface supporting board 20 side without intercepting the luminous light. The display electrode pair 21 is not limited to a transparent electrode and may be also constituted by an electrode of a structure having high aperture ratio, such as a mesh electrode.

On the back surface supporting board 30 are formed a large number of signal electrodes 31 made of metal which extend parallel to each other along each of the many arrayed light-emitting lines 10R, 10G, 10B, 10R, 10G, 10B, . . . in a manner corresponding to each of the light-emitting lines.

When the PTA 100 thus constructed is viewed in a planar manner, the part of intersection of the signal electrode 31 and the display electrode pair 21 becomes a unit light emission region (a unit discharge region). Display is performed by using one of the two display electrodes 211, 212 as a scanning electrode, selecting a light emission region by generating a selective discharge in the part of intersection of this scanning electrode and the signal electrode 31, and generating a display discharge between the display electrodes 211, 212 by use of a wall charge formed on the inner surface of the light-emitting line in the region due to the discharge. The selective discharge is an opposite discharge generated within a light-emitting line between the scanning electrode and the signal electrode 31, which are vertically opposite to each other, and the display electrode is a planar discharge generated within a light-emitting line between the display electrodes 211, 212 disposed parallel on a plane. Owing to this electrode arrangement, multiple light emission regions are formed within a light-emitting line in the longitudinal direction thereof.

FIG. 1 shows a structure in which three electrodes are disposed in one light emission region, and a display discharge is generated by the display electrodes 211, 212. However, the structure is not limited to this one and can be a display discharge generated between the display electrodes 211, 212 and the signal electrode 31. That is, it is possible to adopt an electrode structure of such a type that the display electrodes 211, 212 are formed as one electrode and by using this one display electrode as a scanning electrode, a selective discharge and a display discharge (an opposite discharge) are generated between this display electrode and a data electrode 3.

FIG. 2 is a schematic diagram which shows the structure of light-emitting lines constituting the PTA 100 shown in FIG. 1.

Three light-emitting lines 10R, 10G, 10B are shown here. In each of the light-emitting lines 10R, 10G, 10B, a protective film 12, such as an MgO, is formed on the inner surface of a glass tube 11, and within the glass tube 11 is inserted a boat 13, which is a supporting member in which fluorescent substance layers 14R, 14G, 14B generating fluorescent light of the colors R, G, B are formed (refer to the Japanese Patent Laid-Open No. 2003-86141).

FIG. 3 is a diagram which shows a boat on which a fluorescent substance layer is formed.

The boat 13 has a shape with a semicircular or U-shaped section or with a section similar to these sections, and also has a shape elongated long as with the glass tube 11 (refer to FIG. 2). On the inner side of the boat 13 are formed three kinds of fluorescent substance layers 14R, 14G, 14B (refer to FIG. 2; represented here by a fluorescent substance layer 14) corresponding to the three kinds of light-emitting lines 10R, 10G, 10B shown in FIGS. 1 and 2.

Again with reference to FIG. 2, the description will be continued.

Each of the light-emitting lines 10R, 10G, 10B shown in FIG. 2 is constructed by inserting the boat 13 having the shape shown in FIG. 3 into the glass tube 11. In FIG. 2, it is shown that a display electrode pair 21 constituted by two display electrodes 211, 212 is disposed on these light-emitting lines 10R, 10G, 10B. These two display electrodes 211, 212 are respectively constituted by bus electrodes 211*a*, 212*a* made of metal and transparent electrodes 211*b*, 212*b*.

In the case of the structure shown in FIG. 2, the three light-emitting lines 10R, 10G, 10B which are respectively provided with the three kinds of fluorescent substance layers 14R, 14G, 14B constitute one set, and the region D1 defined by one set of display electrode pair 21 constituted by the two display electrodes 211, 212 becomes one pixel, which is the unit of color image display. The diameter of each of the light-emitting lines 10R, 10G, 10B is typically 1 mm or so, and hence in the case of the structure shown in FIG. 2, the size of the region D1 of one pixel becomes approximately 3 mm×3 mm.

FIG. 4 is a diagram which shows examples of display driving method in one frame period.

A subframe (SF) in which the periods of "initialization," "address" and "display" constitute one set is aligned in multiple numbers. In the period of "initialization", initialization is performed to make preparations for next light emission for each display pixel, in the next period of "address", a display pixel which is to emit light is selected from display pixels which are two-dimensionally aligned in many numbers, and in the next period of "display", the display pixel selected in the period of "address" immediately before this "display" period emits light.

The time length of the period of "display" differs from one SF to another, and depending on combinations of SFs in which light emission is to be performed from among these multiple SFs within one frame, the light emission luminance related to the "one frame" of the display pixel is determined. That is, on the basis of each pixel value of each display pixel within one frame, a light emission pattern is found for each display pixel as to which SF light is used for light emission and which SF light is not used for light emission, among the SFs which are aligned in multiple numbers within the one frame. Each display pixel emits light according to a light emission pattern for each display pixel. As a result of this, an image for one frame is displayed on the display screen.

Part (A) of FIG. 4 shows an example of one-mountain type arrayed SF structure. In this example, the time length of "display" is longest at the head within one frame and the more backward the position of an SF within one frame, the shorter the time. The time length of the "display" has such a shape that, so to speak, one mountain having a peak is formed at the head within the "one frame."

Part (B) of FIG. 4 shows an example of two-mountain type arrayed SF structure. In this example, one frame is divided into a first half portion and a second half portion (the first half portion and the second half portion when one frame is divided like this are each called here a halfframe). For example, one frame having the same SF as arrayed within one frame of part (A) of FIG. 4 is divided into two halfframes (the first half portion and the second half portion). At this time, in each interior of each halfframe, the period of "display" of the SF at the head has the longest time and the more backward, the shorter the time. Therefore, the time length of the "display" has a peak at the head of each of the first half portion and the second half portion, so to speak, two mountains are formed within one frame.

Although there are various ideas about a display driving method other than these two examples, details of them are omitted here.

FIG. 5 is a block diagram of a plasma tube array and FIG. 6 is a function block diagram of a display circuit portion of the plasma tube array shown in FIG. 5.

FIG. 5 shows, as the component elements of the plasma tube array 100, a display circuit section 100B, which is constituted by a memory of conversion table of pixel value-light emission patterns 50*a*, a data control circuit 51, a driver control circuit 52, a signal electrode driver 53, a scanning electrode driver 54 and a common electrode driver 55, in addition to an image display section 100A in which light-emitting lines are arrayed and which has been described with reference to FIG. 1 to FIG. 3.

In this display circuit section 100B, processing for pixel value-light emission pattern conversion 61 and driving processing 62 are executed as shown in FIG. 6.

In processing for pixel value-light emission pattern conversion 61, for each pixel value, input image data is converted to a light emission pattern as to in which subframe (SF) light is emitted and in which subframe light is not emitted. In driving processing 62, the light emission of each pixel is controlled according to a light emission pattern obtained in the processing for pixel value-light emission pattern conversion 61.

In the circuit block shown in FIG. 5, the processing for pixel value-light emission pattern conversion 61 is performed by the memory of conversion table of pixel value-light emission patterns 50*a* and the data control circuit 51. That is, in the memory of conversion table of pixel value-light emission patterns 50*a* are stored pixel value-light emission conversion tables in which pixel values and light emission patterns are associated with each other, image data is inputted to the data control circuit 51 sequentially for each frame, and in the data control circuit 51, conversion tables of pixel value-light emission patterns are referred to, whereby the pixel value of each pixel in the image data for each frame is converted to a light emission pattern.

Data which represents light emission patterns thus obtained, along with the address information of pixels, is inputted to the driver control circuit 52.

The driving processing 62 shown in FIG. 6 is performed by the driver control circuit 52, the signal electrode driver 53, the scanning electrode driver 54 and the common electrode driver 55, which are shown in FIG. 5. The driver control circuit 52 receives the address information of each pixel and the light emission pattern data of each pixel, and in accordance with the received address information and data, the driver control circuit 52 controls the signal electrode driver 53 which drives the signal electrode 31, the scanning electrode driver 54 which drives each of the two display electrodes 211, 212 which constitute the display electrode pair 21, and the common electrode driver 55, thereby causing the image display section 100A in which light-emitting lines are aligned to display an image corresponding to the image data.

Incidentally, the driving processing 62 shown by a block in FIG. 6, i.e., the processing for displaying an image on the image display section 100A which is performed by the driver control circuit 52 shown in FIG. 5 by driving the three drivers (the signal electrode driver 53, the scanning electrode driver 54 and the common electrode driver 55) is a hitherto known technique, and because this driving processing is not a main subject here, a further description thereof is omitted.

In a PTA having a basic structure as described above, it is conceivable that a display surface on which images are displayed is formed as a curved surface by aligning light-emitting lines along the curved surface, and not in a planer manner.

For example, Japanese Patent Laid-Open No. 2003-92085 describes an example in which the whole area of the wall of a cylindrical room is a display surface.

By forming the display surface of a curved surface in this manner, it is possible to greatly increase the range of uses of a PTA.

Even in a case where a display surface is formed as a curved surface by arraying light-emitting lines so as to extend along the curved surface, there is no problem for a portion where the geometric environment of light-emitting lines is common to all light-emitting lines as in the case of the cylindrical arraying, which is shown in Japanese Patent Laid-Open No. 2003-92085. However, a problem occurs for a portion where the geometric environment differs from one light-emitting line to another.

FIG. 7 is a schematic diagram which shows multiple arrayed light-emitting lines. FIG. 8 is a schematic diagram which shows the array of the light-emitting lines 10 taken along the arrow A-A of FIG. 7. FIG. 9 is a schematic diagram which shows the array of the light-emitting lines 10 taken along the arrow B-B of FIG. 7.

The multiple light-emitting lines shown in FIG. 7 are arrayed in such a manner that part of the display region of a display surface forms a plane surface as shown in FIG. 8 and another part of the display region forms a curved surface as shown in FIG. 9 (in the example shown here, a convex surface having a positive curvature).

Two display electrodes 121, 122, which extend in the direction laterally intersecting these multiple light-emitting lines 10 are shown in FIG. 7. By applying a driving voltage to these two display electrodes 121, 122, a discharge is generated in the regions corresponding to the discharge slit between these two display electrodes 121, 122 within the light-emitting lines 10, with the result that light emission occurs. The surface of the front surface supporting board 20 in which these two display electrodes 121, 122 are formed is formed partially as a plane surface and partially as a curved surface according to the array of the light-emitting lines 10.

When multiple regions in different geometric environments are present on one display surface as in this example, display luminance differs from one region to another, posing the problem that nonuniformity in luminance occurs in terms of the whole area of the display surface.

That is, compared to the plane surface (zero curvature) shown in FIG. 8, in the case of a convex surface (positive curvature) as shown in FIG. 9, the width of a pixel for which one light-emitting line takes charge of light emission widens and light emission luminance per unit area decreases accordingly.

FIG. 10 is an explanatory diagram of a decrease rate of luminance.

Part (A) of FIG. 10 shows a display surface which is bent at a right angle by one light-emitting line. In this case, one light-emitting line at the corner has an angle of $\pi/2$ and when the radius of the light-emitting line is expressed by r, the area of the region in which only this light-emitting line takes partial charge of light emission widens by $\pi r/2$ in terms of length. In this case, the luminance of the portion at this corner decreases, for example, by about 44% compared to other plane surface portion.

Part (B) of FIG. 10 shows a display surface which is bent at a right angle through two light-emitting lines. In this case, the two light-emitting lines at the corner each have an angle of $\pi/4$ and the area of the region in which the two light-emitting lines take partial charge of light emission widens by $\pi r/4$ for each in terms of length. In this case, the luminance of the portion at this corner decreases, for example, by about 29% compared to other plane surface portion.

Part (C) of FIG. 10 shows a display surface which is bent at a right angle through three light-emitting lines. In this case, the three light-emitting lines at the corner each have an angle of $\pi/6$ and the area of the region in which the three light-emitting lines take partial charge of light emission widens by $\pi r/6$ for each in terms of length. In this case, the luminance of the portion at this corner decreases, for example, by about 17% compared to other plane surface portion.

Thus, the larger the curvature (Part (A) of FIG. 10 shows a large curvature and Part (C) of FIG. 10 shows a small curvature), the more the luminance decreases.

Although the description has been given here of a display surface which is a convex surface having a positive curvature, the same thing applies also to the case of a display surface which is a concave surface having a negative curvature. In the case of a display surface which is a concave surface, the larger the absolute value of the curvature, the more the luminance increases.

SUMMARY OF THE INVENTION

The present invention has been made in view of the above circumstances and provides an array display apparatus which can display an image of uniform luminance irrespective of the planar shape of a display surface when image data representing a uniform image is inputted.

An array display apparatus of the present invention includes: multiple light-emitting tubes, which each have a fluorescent substance layer inside and are arrayed parallel to each other and along a display surface having a partially different curvature; a front surface supporting member and a back surface supporting member, which support these multiple light-emitting tubes by sandwiching the light-emitting tubes and extend over on the side of the display surface and on the side of a back surface, respectively; multiple display electrodes, which are formed on a surface opposite to the light-emitting tubes of the front surface supporting member and extend in a direction in which the display electrodes span the light-emitting tubes; multiple signal electrodes, which are formed on a surface opposite to the light-emitting tubes of the back surface supporting member in a manner corresponding to each of the light-emitting tubes and extend in a direction along the light-emitting tubes; and a luminance adjusting section which adjusts luminance by each of the light-emitting tubes according to a partial curvature of the display surface.

Because an array display apparatus of the present invention has the luminance adjusting section and adjusts luminance according to a partial curvature of the display surface, the occurrence of streaky regions with decreased luminance or increased luminance is prevented.

In the array display apparatus of the present invention, it is preferred that the luminance adjusting section is such that the larger an absolute value of curvature of a region of the display surface formed by a light-emitting tube, which surface is a convex surface, the higher the luminance of the display surface. Also, it is preferred that the luminance adjusting section is such that the larger an absolute value of curvature of a region of the display surface formed by a light-emitting tube, which surface is a concave surface, the lower the luminance of the display surface.

In the array display apparatus of the present invention, it is preferred that the luminance adjusting section includes a feature that the display electrodes have such an electrode structure that transmittance differs depending on a partial curvature of the display surface. Also, it is preferred that the luminance adjusting section includes a feature that the display electrodes have such an electrode structure that discharge efficiency differs depending on a partial curvature of the display surface when the same voltage is applied.

In the array display apparatus of the present invention, it is preferred that the luminance adjusting section includes a feature that the thickness of the fluorescent substance layer within the light-emitting tubes which form regions of the display surface differs depending on the curvature of each of the regions, or it is also preferred that the luminance adjusting section includes a feature that the position of the fluorescent substance layer disposed within the light-emitting tubes which form regions of the display surface differs depending on the curvature of each of the regions.

Furthermore, in the array display apparatus of the present invention, it is also preferred that the array display apparatus further includes a driving circuit, to which image data is input and which drives the display electrodes and the signal electrodes according to the image data, thereby causing an image by luminance distribution to be displayed on the display surface, and wherein the luminance adjusting section includes a data conversion circuit, to which image data is input and which gives weight, which differs depending on the curvature of each of regions constituting the display surface, to a pixel value of a pixel which is taken partial charge of by the light-emitting tube corresponding to each of the regions, generates new image data thereby and inputs the new image data to the driving circuit.

According to the present invention described above, it is possible to obtain an image of uniform luminance when image data showing a uniform image is inputted.

DETAILED DESCRIPTION OF THE INVENTION

Embodiments of the present invention will be described below.

In various embodiments described below, the basic structure is the same as the PTA described by referring to FIG. 1 to FIG. 6 above. Therefore, overlapping descriptions are omitted here and various embodiments will be described with respect points in which they differ from the PTA.

Figure 11:
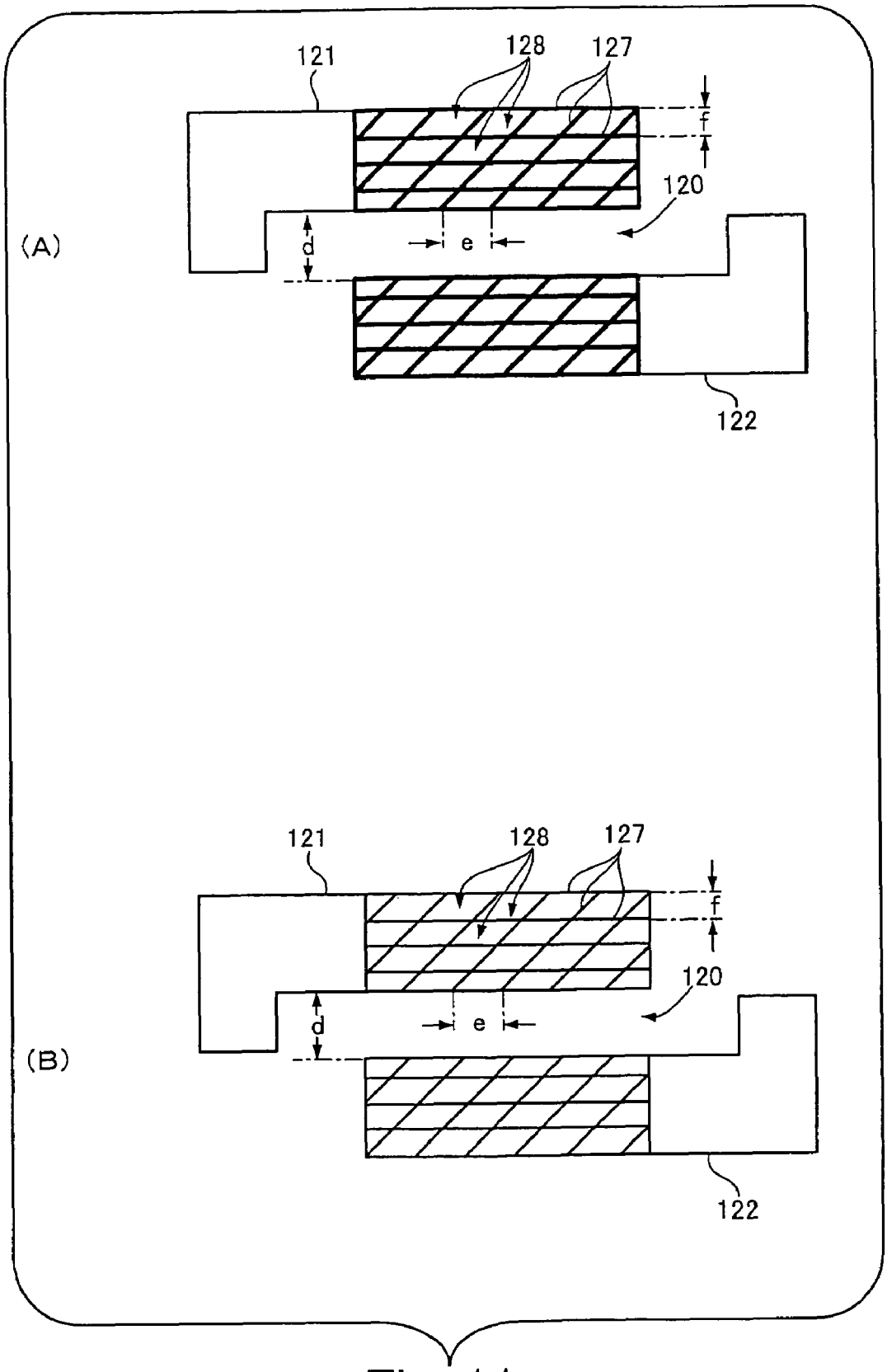
FIG. 11 is a diagram which shows a display electrode pair which is constituted by two display electrodes.

FIG. 11 is a diagram which shows a display electrode pair which is constituted by two display electrodes.

In both parts (A) and (B) of FIG. 11 are shown two display electrodes 121, 122 which are disposed with a discharge gap 120 having a width d sandwiched between the two. In the case of the display electrode pair shown in part (A) of FIG. 11, the portions opposed to each other with the discharge gap 120 of the display electrodes 121, 122 sandwiched therebetween (the portions which act substantially as discharge electrodes) have an electrode structure in which relatively thick fine metal wires 127 are installed in mesh form. In the case of the display electrode pair of part (B) of FIG. 11, these portions have an electrode structure in which fine metal wires 127 of relatively fine diameter are installed in mesh form. Therefore, in the case of part (A) of FIG. 11, apertures 128 which are enclosed by the fine metal wires 127 and through which the light from light-emitting lines is transmitted are relatively narrow and, for this reason, the transmittance of light is relatively low. On the other hand, in the case of part (B) of FIG. 11, apertures 128 are relatively wide and the transmittance of light is relatively high.

The transmittance of light may be adjusted so that uniform luminance is obtained by forming display electrodes from metal meshes having different aperture ratios depending on the curvature of each region of the display surface in this manner.

In FIG. 11, by way of example, the width d is 400 μm, the wire width of the display electrodes 121, 122 is 20 μm (in the case of part (A) of FIG. 11) and 16 μm (in the case of part (B) of FIG. 11), and the size e, f of the aperture 128 is (100 μm—wire width) in both cases.

Figure 12:
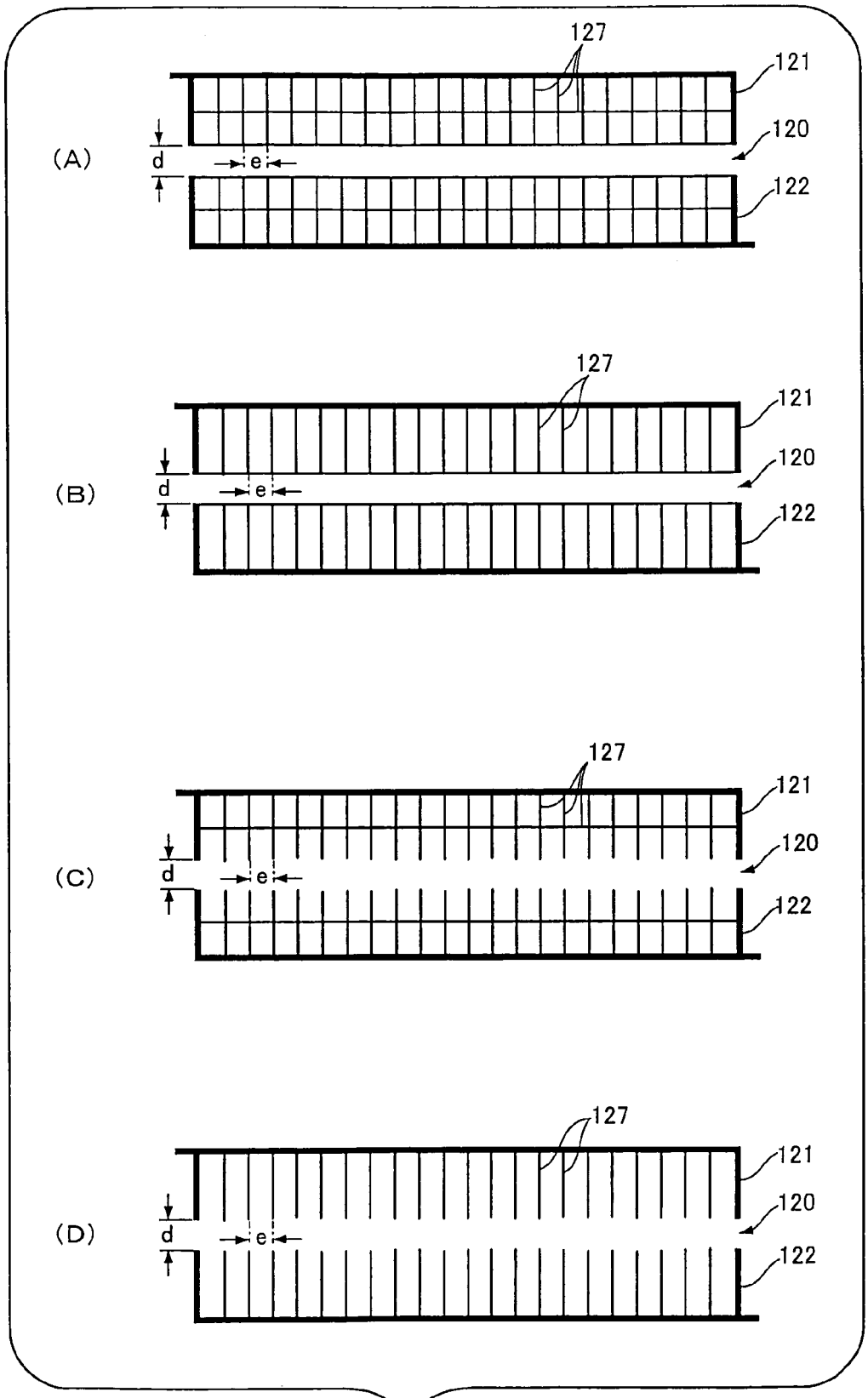
FIG. 12 is a diagram which shows other means to adjust luminance.

FIG. 12 is a diagram which shows other means to adjust luminance.

In all parts (A) to (D) of FIG. 12 are shown two display electrodes 121, 122 which are opposed to each other, with a discharge gap 120 having a width d sandwiched between the two. As compared to the display electrodes of part (A) of FIG. 12 which are wired in grid form, in the display electrodes of part (B) of FIG. 12, the fine metal wires which extend in the grooves in the middle are eliminated. Therefore, the aperture ratio is high and the transmittance of light is high. In the case of part (C) of FIG. 12, compared to part (A) of FIG. 12, the fine metal wires which are adjacent to the discharge slit and extend laterally are eliminated. In this case, the intensity of a discharge in the discharge gap 120 changes. Therefore, the intensity of luminous light differs and luminance changes.

In the case of part (D) of FIG. 12, the fine metal wires which extend laterally are eliminated and the display electrodes are in the form of the teeth of a comb. Accordingly, as with the case of part (C) of FIG. 12, the discharge intensity of the discharge slit 120 changes, the intensity of luminous light differs and luminance changes.

In FIG. 12, by way of example, the width d is 400 μm, the wire width of the display electrodes 121, 122 is 20 μm, and the size e of the aperture is (425 μm—wire width).

As shown in FIG. 11 and FIG. 12, luminance can be adjusted by adjusting the aperture ratio which depends on electrode structures or by adopting electrode structures having different discharge intensities.

Figure 13:
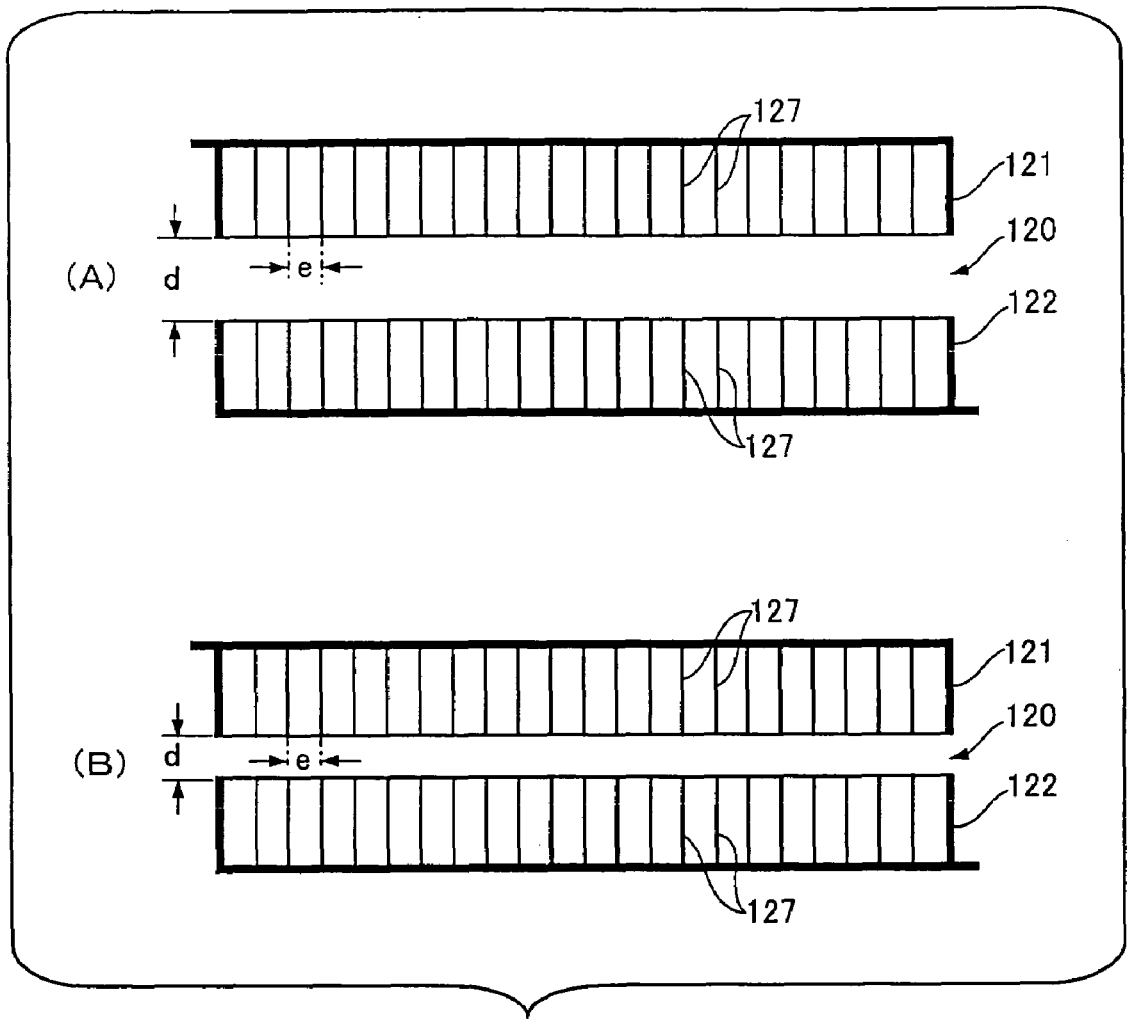
FIG. 13 is a diagram which shows other means to adjust luminance.

FIG. 13 is a diagram which shows other means to adjust luminance.

In both of parts (A) and (B) of FIG. 13 are shown two display electrodes 121, 122 which are opposed to each other, with a discharge gap 120 having a width d sandwiched between the two. These two display electrodes 121, 122 are formed from fine metal wires 127 which are installed in ladder form.

Also here, a description will be given by comparing to the electrode structure of part (A) of FIG. 13.

In part (B) of FIG. 13, because the width d of the discharge gap is narrow, a strong electric field is obtained accordingly and light emission can be maintained by a low discharge maintaining voltage. For this reason, when the same voltage is applied, strong luminous light can be obtained by generating a strong discharge and luminance increases.

In FIG. 13, by way of example, the width d is 400 μm (in the case of part (A) of FIG. 13 and 320 μm (in the case of part (B) of FIG. 13), the wire width of the display electrodes 121, 122 is 20 μm, and the size e of the aperture is (425 μm—wire width).

As shown in FIG. 13, luminance can also be adjusted by adjusting the discharge maintaining voltage which depends on electrode structures (by adjusting the discharge efficiency when the same voltage is applied) and an image of uniform luminance can be obtained also by performing this adjustment according to curvature.

Figure 14:
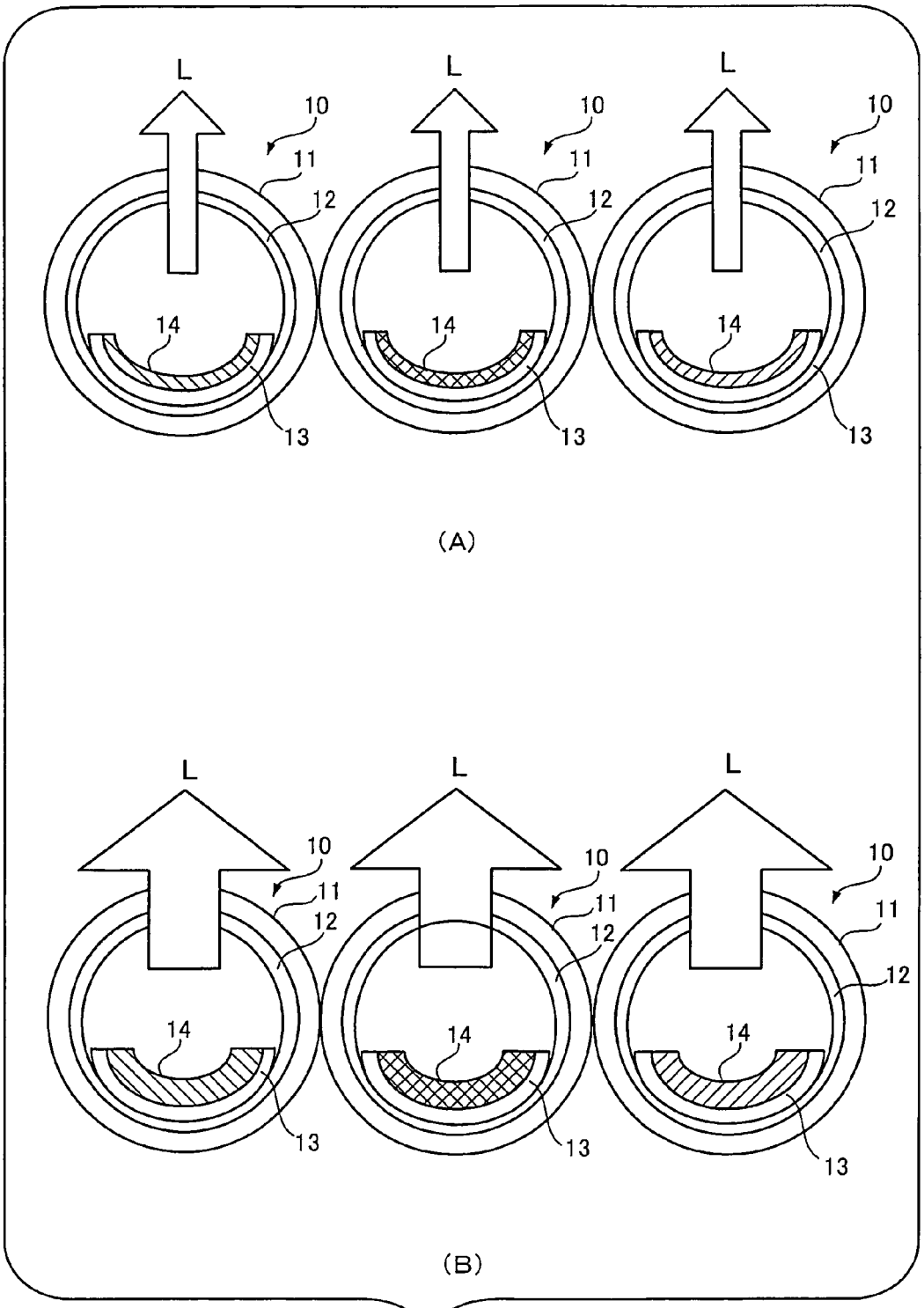
FIG. 14 is a diagram which shows the inner structure of light-emitting lines.

FIG. 14 is a diagram which shows the inner structure of light-emitting lines.

Figure 1:
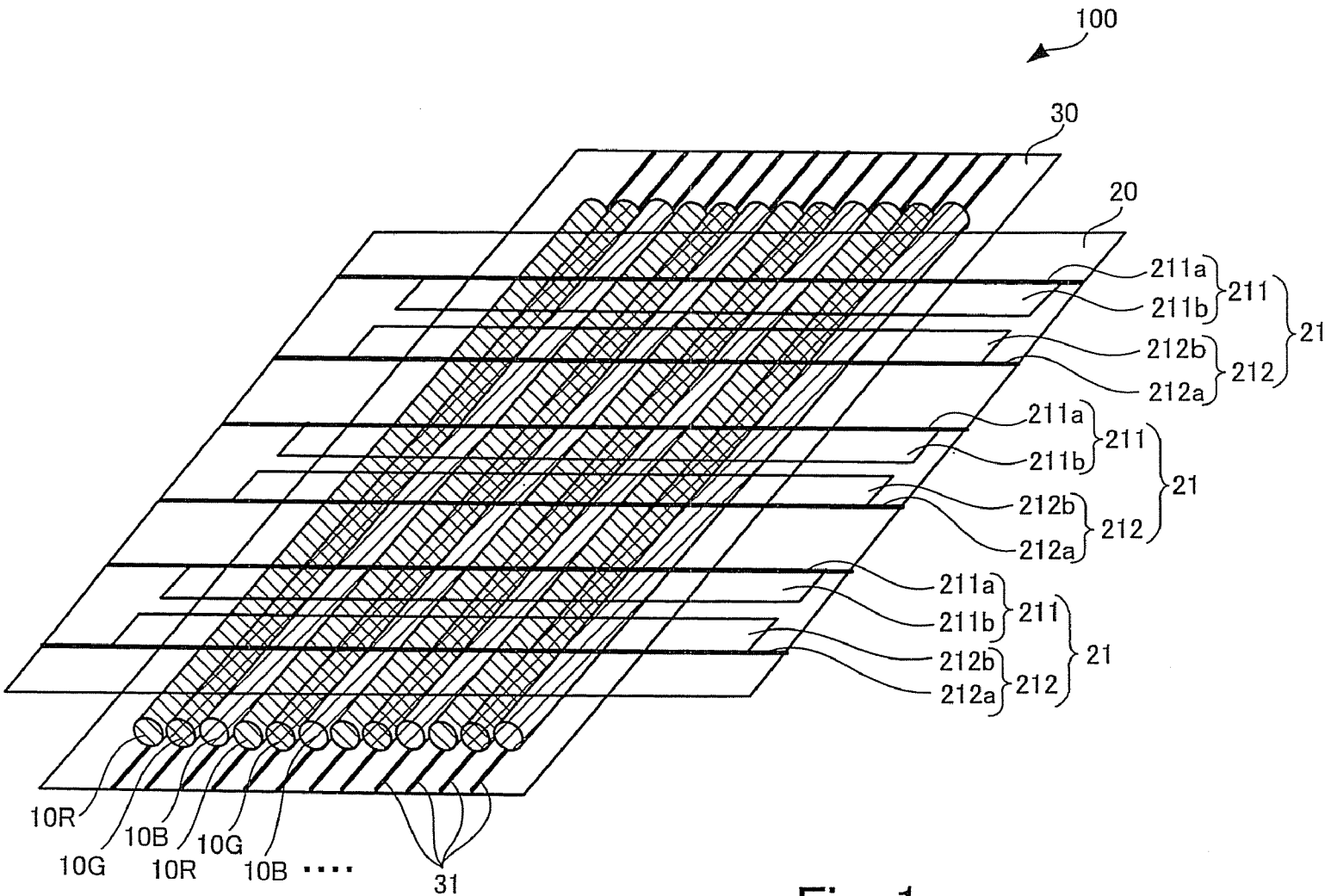
Fig. 1 PRIOR ART
FIG. 1 is a perspective view which shows the basic structure of a plasma tube array, which is an example of an array display apparatus.
Figure 2:
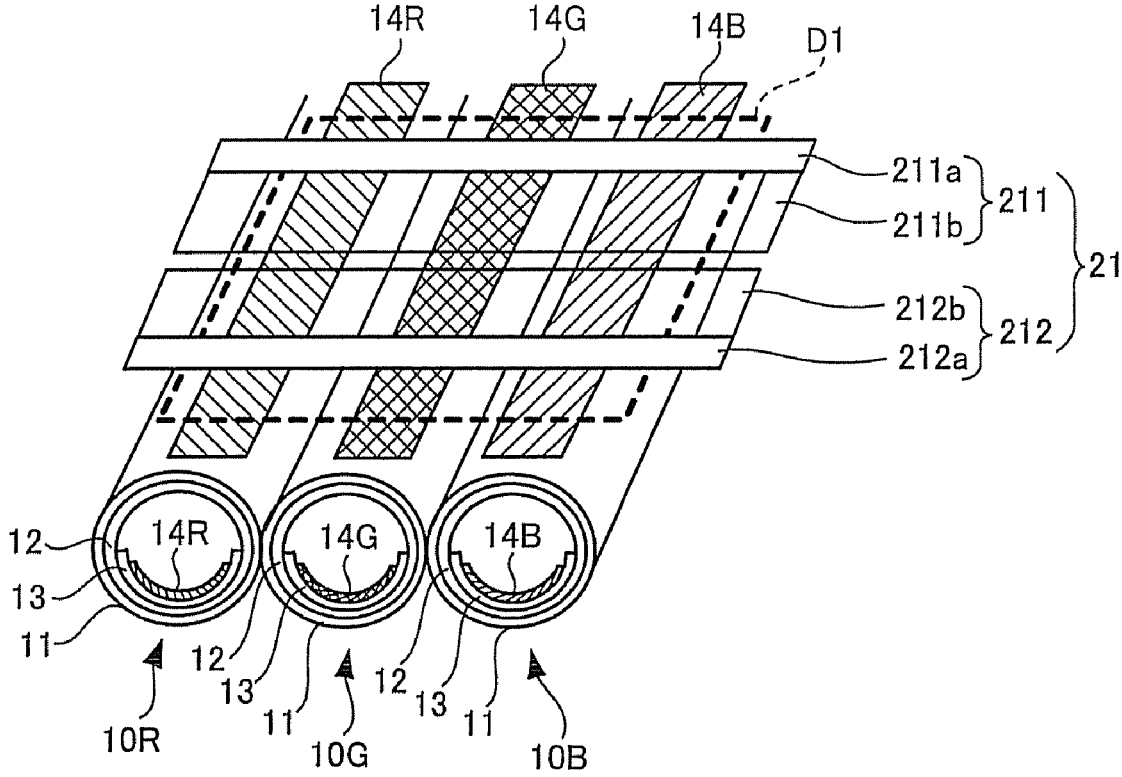
Fig. 2 PRIOR ART
FIG. 2 is a schematic diagram which shows the structure of light-emitting lines constituting the plasma tube array shown in FIG. 1.
Figure 3:
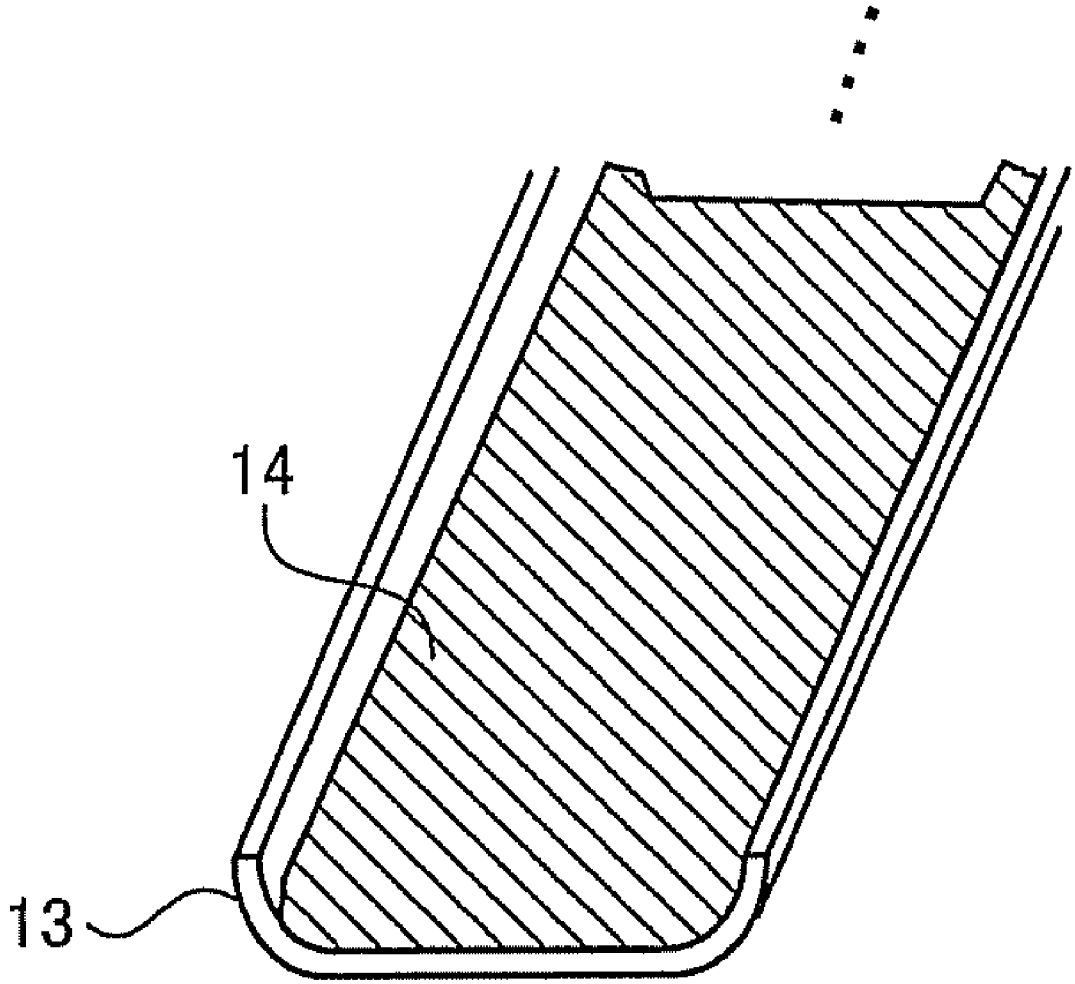
Fig. 3 PRIOR ART
FIG. 3 is a diagram which shows a boat on which a fluorescent substance layer is formed.
Figure 4:
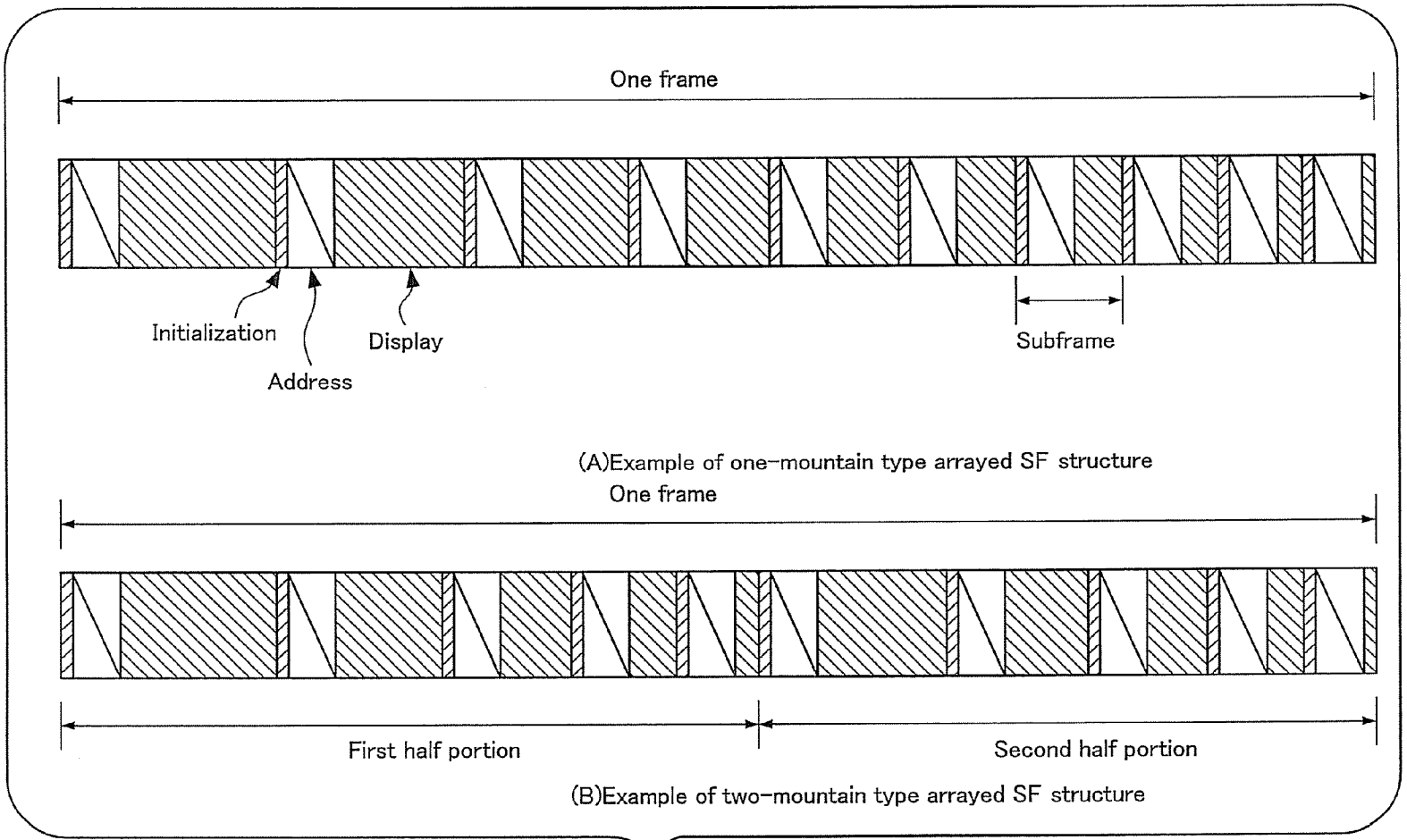
Fig. 4 PRIOR ART
FIG. 4 is a diagram which shows examples of display driving method in one frame period.

As described with reference to FIG. 2, the light-emitting line 10 has such a structure that a protective film 12 is formed on the inner surface of a glass tube 11, and within the glass tube 11 is inserted a boat 13 in which a fluorescent substance layer 14 is formed.

In the case of part (A) of FIG. 14, a fluorescent substance layer 14 which has a relatively small layer thickness is formed on a boat 13. In the case of part (B) of FIG. 14, a fluorescent substance layer 14 which has a relatively large layer thickness is formed on a boat.

Even when other conditions such as electrode structures are all common, relatively weak luminous light L is obtained in the case of part (A) of FIG. 14 and relatively strong luminous light L is obtained in the case of part (B) of FIG. 14.

In FIG. 14, by way of example, the film thickness of the fluorescent substance layer 14 is 20 μm (in the case of part (A) of FIG. 14) and 30 μm (in the case of part (B) of FIG. 14) and the spacing between the boat surface and the tube wall is 700 μm.

Luminance which is uniform irrespective of curvature may be obtained by adopting light-emitting lines in which the thickness of the fluorescent substance layer is adjusted according to curvature like this.

Figure 15:
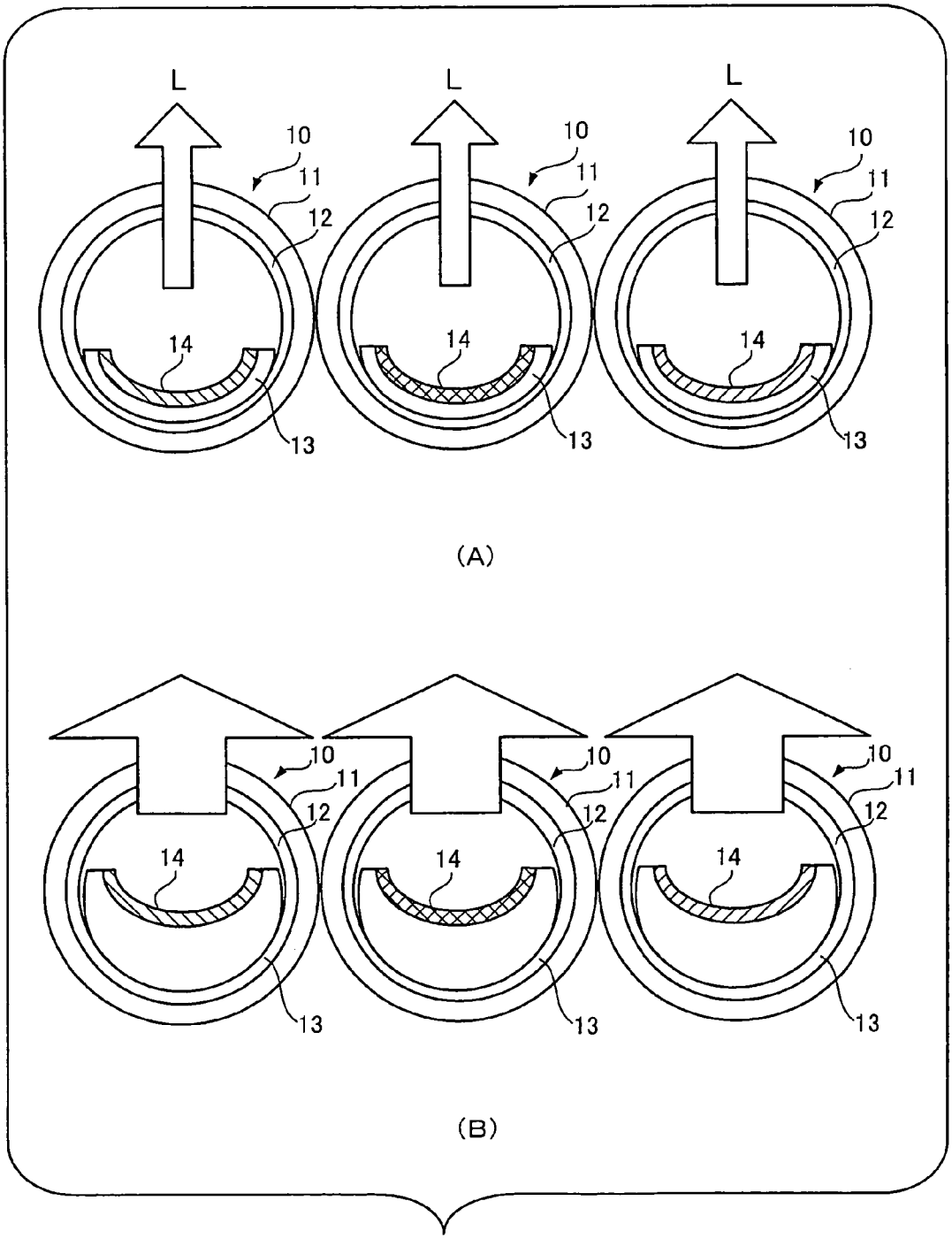
FIG. 15 is a diagram which shows the inner structure of light-emitting lines.

As with FIG. 14, FIG. 15 is also a diagram which shows the inner structure of light-emitting lines.

Part (A) of FIG. 15 is the same as part (A) of FIG. 14.

Compared to part (A) of FIG. 15, in part (B) of FIG. 15, the boat 13 is formed thick and the fluorescent substance layer 14 is raised upward accordingly, although the layer thickness of the fluorescent substance layer 14 is the same.

In FIG. 15, by way of example, the film thickness of the fluorescent substance layer 14 is 20 μm and the spacing between the boat surface and the tube wall is 700 μm (in the case of part (A) of FIG. 15) and 560 μm (in the case of part (B) of FIG. 15).

Also in the case of part (B) of FIG. 15, compared to the case of part (A) of FIG. 15, strong luminous light L can be obtained when other conditions are the same, and luminance can be adjusted.

Figure 16:
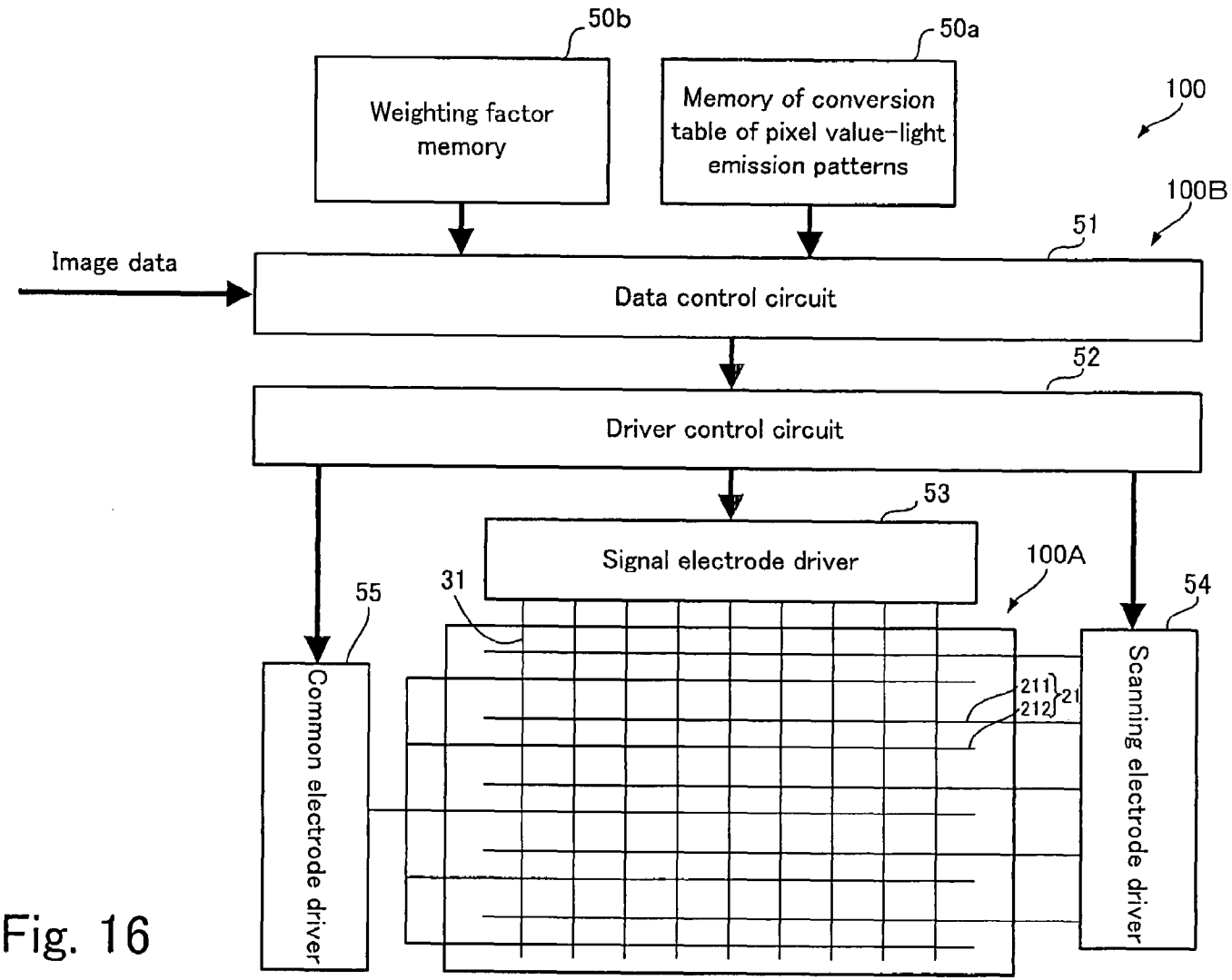
FIG. 16 is a block diagram of a plasma tube array.
Figure 17:
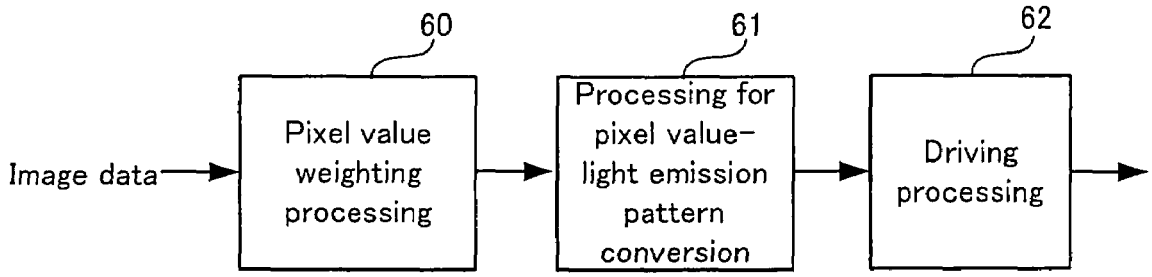
FIG. 17 is a function block diagram of a display circuit portion of the plasma tube array shown in FIG. 16.

FIG. 16 is a block diagram of a plasma tube array and FIG. 17 is a function block diagram of a display circuit portion of the plasma tube array shown in FIG. 16. These FIGS. 16 and 17 correspond to FIGS. 5 and 6, respectively, in the conventional example.

Figure 5:
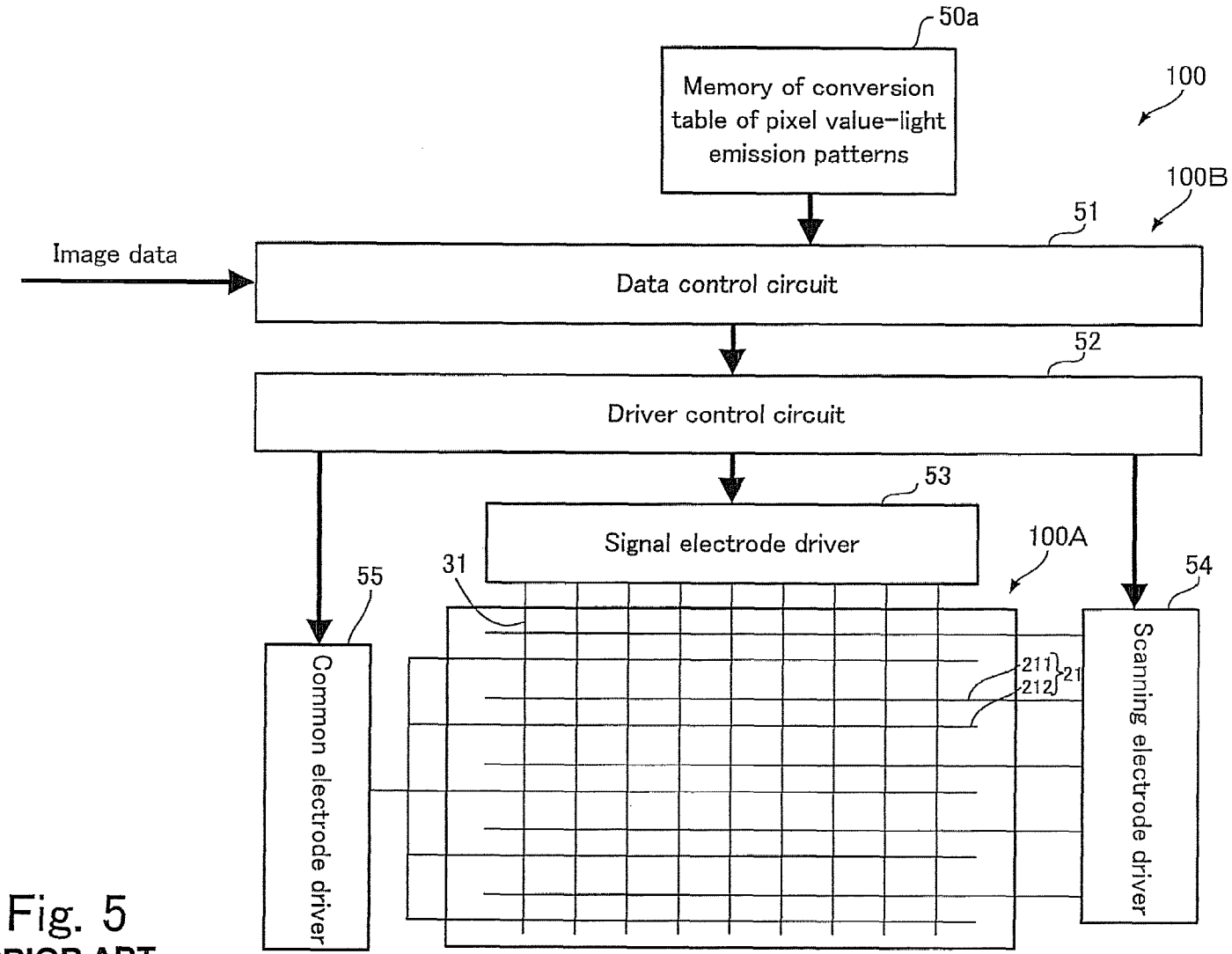
Fig. 5 PRIOR ART
FIG. 5 is a block diagram of a plasma tube array.
Figure 6:
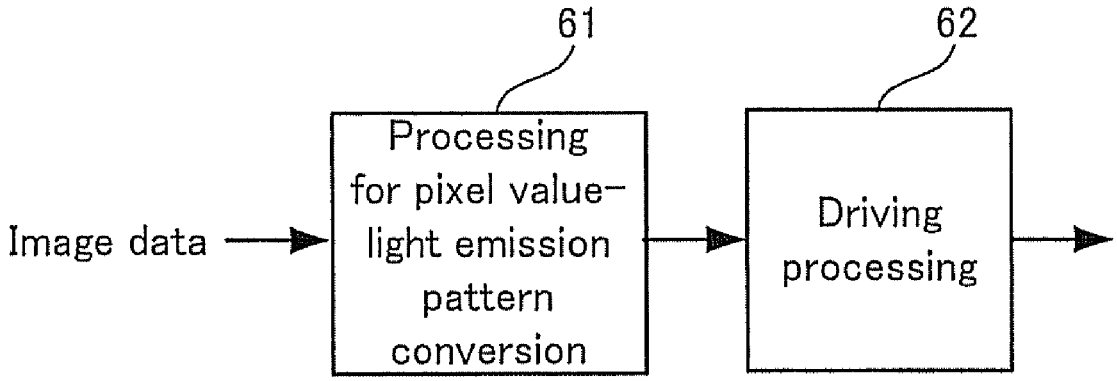
Fig. 6 PRIOR ART
FIG. 6 is a function block diagram of a display circuit portion of the plasma tube array shown in FIG. 5.
Figure 7:
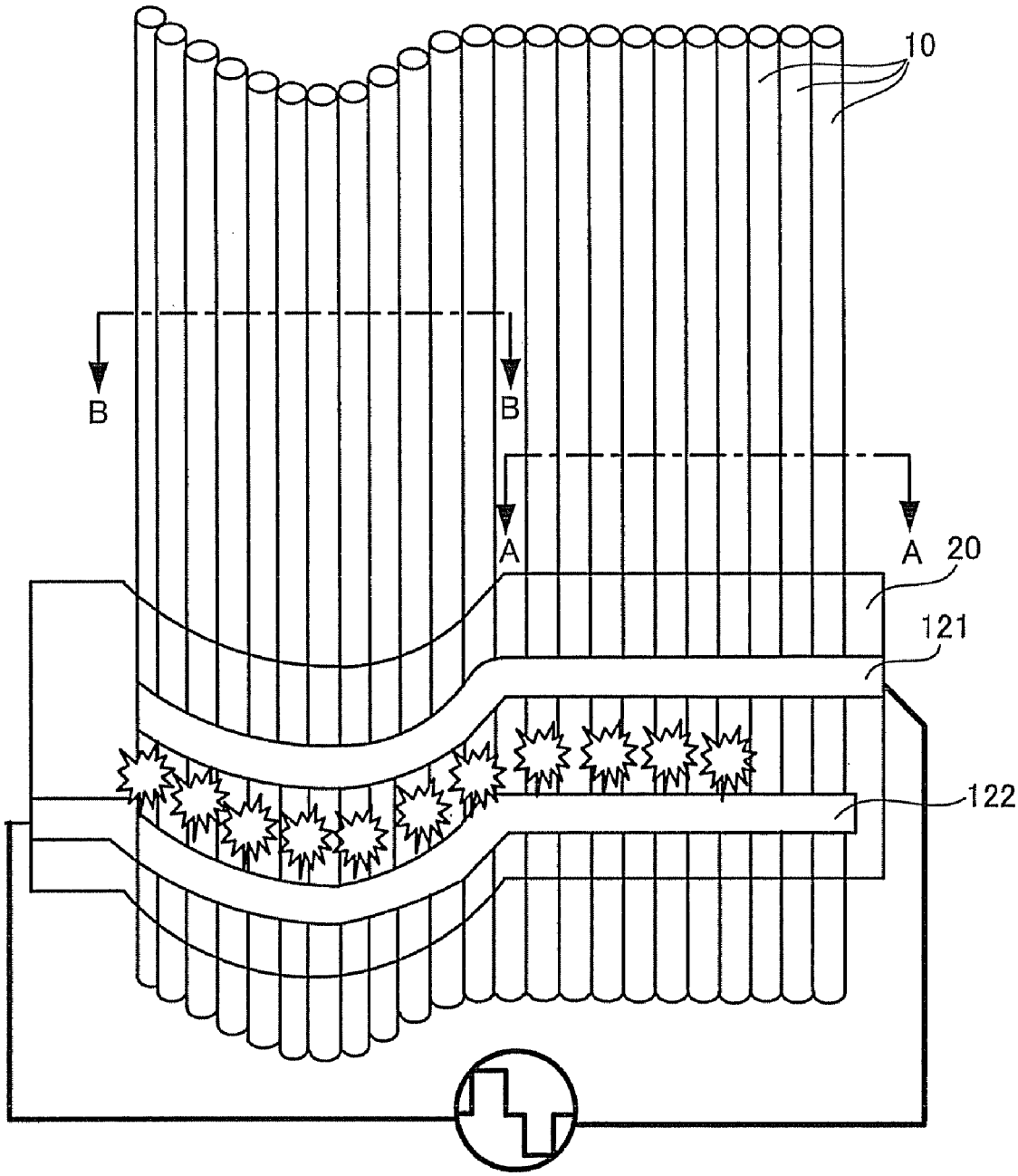
Fig. 7 PRIOR ART
FIG. 7 is a schematic diagram which shows multiple arrayed light-emitting lines.
Figure 8:
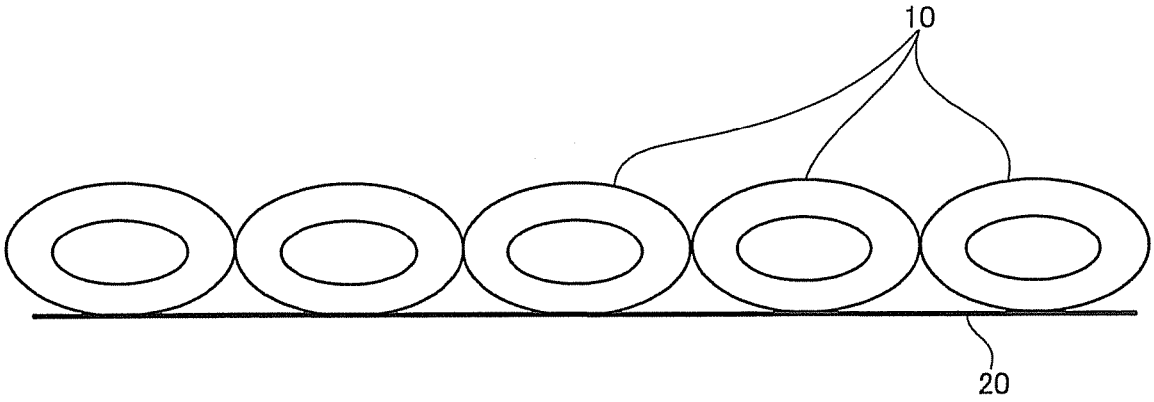
Fig. 8 PRIOR ART
FIG. 8 is a schematic diagram which shows the array of the light-emitting lines taken along the arrow A-A of FIG. 7.
Figure 9:
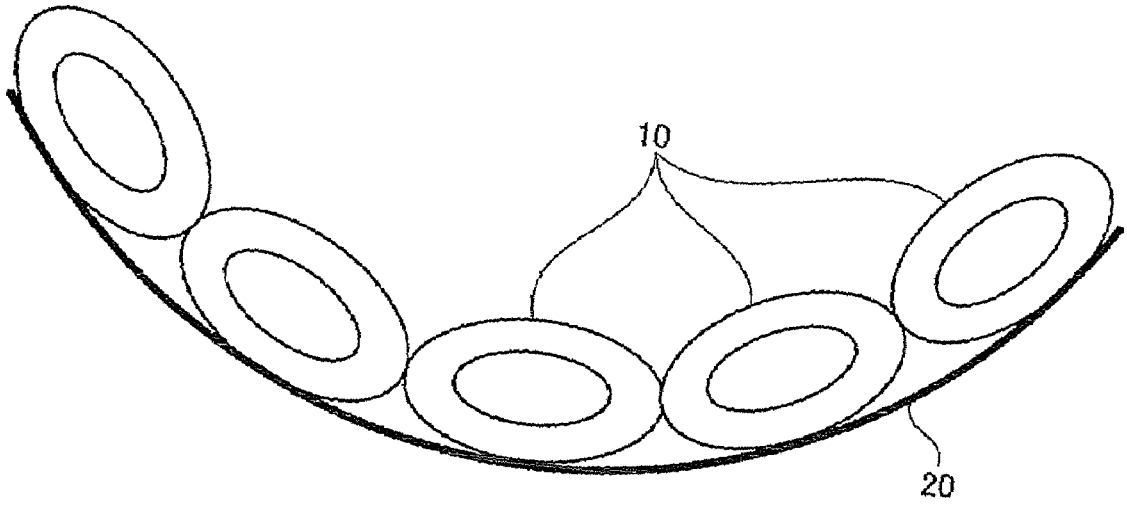
Fig. 9 PRIOR ART
FIG. 9 is a schematic diagram which shows the array of the light-emitting lines taken along the arrow B-B of FIG. 7.
Figure 10:
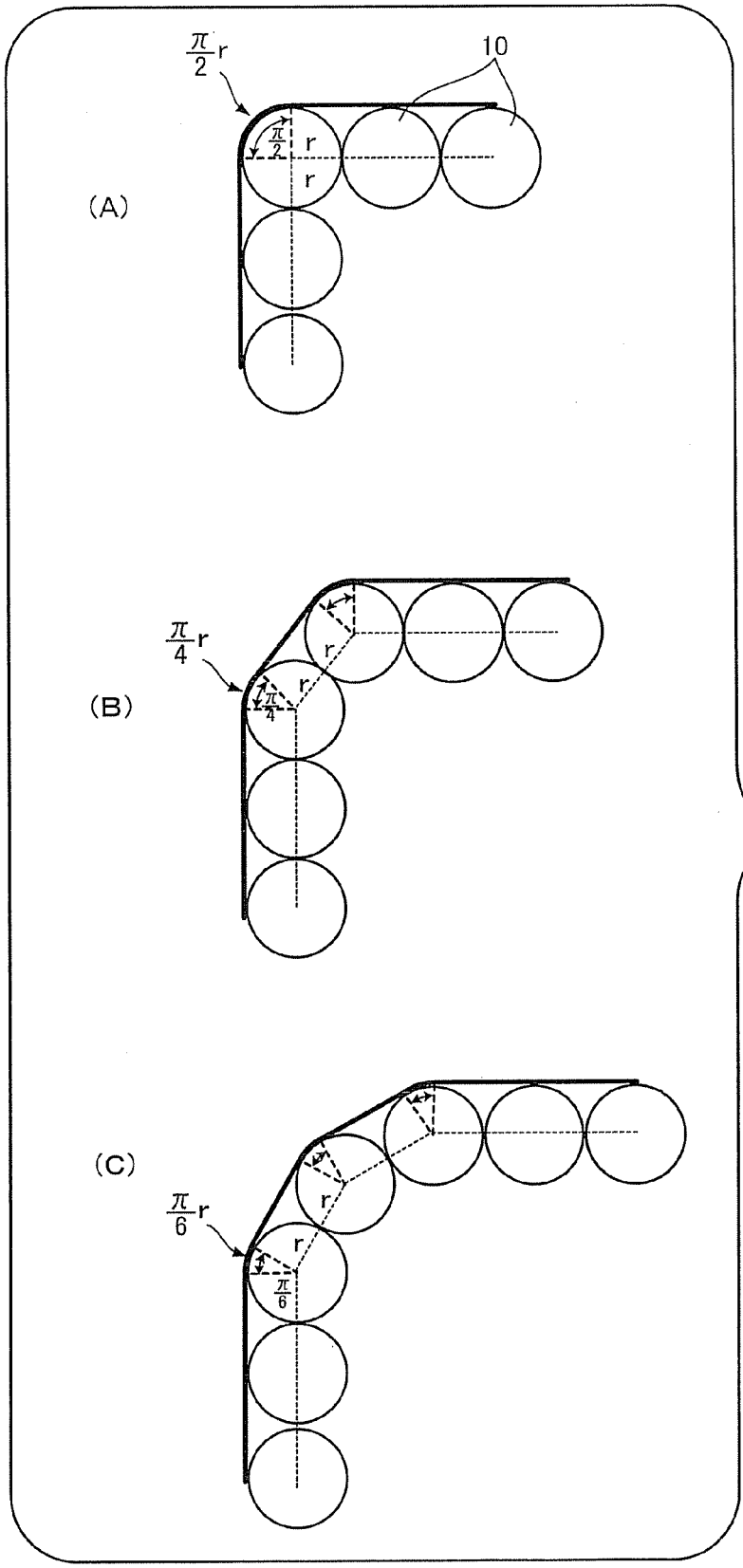
Fig. 10 PRIOR ART
FIG. 10 is an explanatory diagram of a decrease rate of luminance.

Points at which the present invention differs from the conventional technique described with reference to FIGS. 5 and 6 are described here.

Compared to FIG. 5, a weighting factor memory **50*b* is added to a display circuit section 100B of a plasma tube array 100 shown in FIG. 16**.

Tables of correspondences between an address of a display pixel and a weighting factor of a pixel value of the address are stored in this weighting factor memory **50*b***.

When image data is inputted to the data control circuit 51, pixel value weighting processing 60, which is shown in FIG. 17, is first executed in this data control circuit 51.

In this pixel value weighting processing 60, for each of the pixel values constituting an inputted image data, the weighting factor memory **50*b*** is referred to by using an address of each pixel value as an index, thereby to find a weighting factor for each pixel value, and each pixel value is weighted by this weighting factor, whereby image data constituted by new pixel values is generated.

Weighting factors which correspond to the curvature of the display surface are stored in this weighting factor memory **50*b*. Therefore, image data obtained after the pixel value weighting processing 60** is executed becomes image data for which a decrease or increase in luminance by curvature has been corrected.

In the data control circuit 51, processing for image value-light emission pattern conversion 61 is executed for the image data after the pixel value weighting processing 60, and driving processing 62 is executed by the driver driving circuit 52 and the like. For the processing for pixel value-light emission pattern conversion 61 and the driving processing 62, have already described with reference to FIGS. 5 and 6, their overlapping descriptions are omitted here.

As described with reference to FIGS. 16 and 17, a display screen of uniform luminance can be obtained also by weighting a pixel value according to the geometric shape of arrayed light-emitting lines.

What is claimed is:

1. An array display apparatus, comprising:

a plurality of light-emitting tubes, which each have a fluorescent substance layer inside and are arrayed parallel to each other and along a display surface at least a part of which has a curvature;

a front surface supporting member and a back surface supporting member, which support the light-emitting tubes by sandwiching the light-emitting tubes and extend over on the side of the display surface and on the side of a back surface, respectively;

a plurality of display electrodes, which are formed on a surface opposite to the light-emitting tubes of the front surface supporting member and extend in a direction in which the display electrodes span the light-emitting tubes;

a plurality of signal electrodes, which are formed on a surface opposite to the light-emitting tubes of the back surface supporting member in a manner corresponding to each of the light-emitting tubes and extend in a direction along the light-emitting tubes; and a luminance adjusting section which adjusts luminance by each of the light-emitting tubes according to a partial curvature of the display surface, and wherein the luminance adjusting section includes a feature that the display electrodes have such an electrode structure that transmittance differs depending on the partial curvature of the display surface.

2. An array display apparatus, comprising:

a plurality of light-emitting tubes, which each have a fluorescent substance layer inside and are arrayed parallel to each other and along a display surface at least a part of which has a curvature;

a front surface supporting member and a back surface supporting member, which support the light-emitting tubes by sandwiching the light-emitting tubes and extend over on the side of the display surface and on the side of a back surface, respectively:

a plurality of display electrodes, which are formed on a surface opposite to the light-emitting tubes of the front surface supporting member and extend in a direction in which the display electrodes span the light-emitting tubes;

a plurality of signal electrodes, which are formed on a surface opposite to the light-emitting tubes of the back surface supporting member in a manner corresponding to each of the light-emitting tubes and extend in a direction along the light-emitting tubes; and a luminance adjusting section which adjusts luminance by each of the light-emitting tubes according to a partial curvature of the display surface, and wherein the luminance adjusting section includes a feature that the display electrodes have such an electrode structure that discharge efficiency differs depending on the partial curvature of the display surface when the same voltage is applied.

3. An array display apparatus, comprising:

a plurality of light-emitting tubes, which each have a fluorescent substance layer inside and are arrayed parallel to each other and along a display surface at least a part of which has a curvature;

a front surface supporting member and a back surface supporting member, which support the light-emitting tubes by sandwiching the light-emitting tubes and extend over on the side of the display surface and on the side of a back surface, respectively;

a plurality of display electrodes, which are formed on a surface opposite to the light-emitting tubes of the front surface supporting member and extend in a direction in which the display electrodes span the light-emitting tubes;

a plurality of signal electrodes, which are formed on a surface opposite to the light-emitting tubes of the back surface supporting member in a manner corresponding to each of the light-emitting tubes and extend in a direction along the light-emitting tubes; and a luminance adjusting section which adjusts luminance by each of the light-emitting tubes according to a partial curvature of the display surface, and wherein the luminance adjusting section includes a feature that the thickness of the fluorescent substance layer within the light-emitting tubes which form regions of the display surface differs depending on the curvature of each of the regions.

4. An array display apparatus, comprising:

a plurality of light-emitting tubes, which each have a fluorescent substance layer inside and are arrayed parallel to each other and along a display surface at least a part of which has a curvature;

a front surface supporting member and a back surface supporting member, which support the light-emitting tubes by sandwiching the light-emitting tubes and extend over on the side of the display surface and on the side of a back surface, respectively;

a plurality of display electrodes, which are formed on a surface opposite to the light-emitting tubes of the front surface supporting member and extend in a direction in which the display electrodes span the light-emitting tubes;

a plurality of signal electrodes, which are formed on a surface opposite to the light-emitting tubes of the back surface supporting member in a manner corresponding to each of the light-emitting tubes and extend in a direction along the light-emitting tubes; and a luminance adjusting section which adjusts luminance by each of the light-emitting tubes according to a partial curvature of the display surface, and wherein the luminance adjusting section includes a feature that the position of the fluorescent substance layer disposed within the light-emitting tubes which form regions of the display surface differs depending on the curvature of each of the regions.

5. An array display apparatus, comprising:

a plurality of light-emitting tubes, which each have a fluorescent substance layer inside and are arrayed parallel to each other and along a display surface at least a part of which has a curvature;

a front surface supporting member and a back surface supporting member, which support the light-emitting tubes by sandwiching the light-emitting tubes and extend over on the side of the display surface and on the side of a back surface, respectively;

a plurality of display electrodes, which are formed on a surface opposite to the light-emitting tubes of the front surface supporting member and extend in a direction in which the display electrodes span the light-emitting tubes;

a plurality of signal electrodes, which are formed on a surface opposite to the light-emitting tubes of the back surface supporting member in a manner corresponding to each of the light-emitting tubes and extend in a direction along the light-emitting tubes;

a luminance adjusting section which adjusts luminance by each of the light-emitting tubes according to a partial curvature of the display surface; and a driving circuit, to which image data is input and which drives the display electrodes and the signal electrodes according to the image data, thereby causing an image by luminance distribution to be displayed on the display surface, and wherein the luminance adjusting section includes a data conversion circuit, to which image data is input and which gives weight, which differs depending on the curvature of each of regions constituting the display surface, to a pixel value of a pixel which is taken partial charge of by the light-emitting tube corresponding to each of the regions, generates new image data thereby and inputs the new image data to the driving circuit.

* * * * *

UNITED STATES PATENT AND TRADEMARK OFFICE

CERTIFICATE OF CORRECTION

PATENT NO. : 7,623,093 B2
APPLICATION NO. : 11/212778
DATED : November 24, 2009
INVENTOR(S) : Koji Shinohe et al.

It is certified that error appears in the above-identified patent and that said Letters Patent is hereby corrected as shown below:

Column 11, in Claim 2, line 21, delete "respectively:" and insert -- respectively --

Signed and Sealed this

Sixteenth Day of February, 2010

David J. Kappos

David J. Kappos
*Director of the United States Patent and Trademark Office*